US006733012B2

(12) United States Patent
Bui et al.

(10) Patent No.: US 6,733,012 B2
(45) Date of Patent: May 11, 2004

(54) METHOD OF PLAYING A CARD GAME WITH MULTIPLE WAGER OPTIONS

(76) Inventors: Hong Bui, 8180 Harvest Crescent, Niagara Falls Ontario (CA), L2H 3G4; Ton B. Nguyen, 4941 Kitchener Street Upper, Niagara Falls Ontario (CA), L2G 1A9

( * ) Notice: Subject to any disclaimer, the term of this patent is extended or adjusted under 35 U.S.C. 154(b) by 0 days.

(21) Appl. No.: 10/219,125

(22) Filed: Aug. 16, 2002

(65) Prior Publication Data

US 2003/0034608 A1 Feb. 20, 2003

Related U.S. Application Data

(60) Provisional application No. 60/312,465, filed on Aug. 16, 2001.

(51) Int. Cl.[7] ..... A63F 1/00

(52) U.S. Cl. ..... 273/292; 273/274; 463/12; 463/13

(58) Field of Search ..... 273/292, 274; 463/12, 13

(56) References Cited

U.S. PATENT DOCUMENTS 5,366,228 A * 11/1994 Kangsanaraks ..... 273/292
5,395,119 A * 3/1995 Jacob et al. ..... 273/274
5,397,128 A * 3/1995 Hesse et al. ..... 273/292
5,496,038 A * 3/1996 Kangsanaraks ..... 273/292
5,702,104 A * 12/1997 Malek et al. ..... 273/292
5,782,473 A * 7/1998 Chou et al. ..... 273/292
6,511,072 B1 * 1/2003 Phommabouth et al. .... 273/292

OTHER PUBLICATIONS

LyFoung—Pub. No.: US 2003/0050106 A1—Method of Playing Three Card Game—Mar. 13, 2003.*

SU—Pub. No.: US 2002/0135130 A1—Super Baccarat Card Game—Sep. 26, 2002.*

* cited by examiner

*Primary Examiner*—Benjamin H. Layno
*Assistant Examiner*—Dolores R. Collins
(74) *Attorney, Agent, or Firm*—Eugene J. A. Gierczak; Miller Thomson LLP

(57) ABSTRACT

A method of playing a mini-Baccarat type game is disclosed. The game is played using a playing surface and playing cards. Three cards are randomly dealt to each of a plurality of players and the dealer. The method includes multiple wager options, including the step of placement of a bet that the cumulative value of the three cards of one or more of the plurality of players will exceed the cumulative value of the three cards of the dealer. A game surface for playing the mini-Baccarat type game of the present invention is also disclosed.

9 Claims, 1 Drawing Sheet

METHOD OF PLAYING A CARD GAME WITH MULTIPLE WAGER OPTIONS

This application claims the benefit of Provisional application Ser. No. 60/312,465 filed Aug. 16, 2001.

FIELD OF THE INVENTION

The present invention relates to a method for playing a card game based on Baccarat or Mini-Baccarat with multiple wager options. The present invention further relates to a method for playing a modified Mini-Baccarat card game with an integrated commission.

BACKGROUND OF THE INVENTION

The card game Mini-Baccarat is well known, particularly in the casino environment.

Mini-Baccarat is generally played on a Blackjack sized table with up to seven players, wherein the players are able to touch their cards. Mini-Baccarat generally uses eight standard fifty-two card decks. Mini-Baccarat on the other hand uses a standard deck of fifty-two playing cards and is usually dealt from a shoe having multiple decks that have been shuffled together prior to the beginning of play.

This invention relates in general to Mini-Baccarat. The rules for Mini-Baccarat and Baccarat are similar, only a smaller number of cards are used in Baccarat.

The object of the game of Mini-Baccarat is for the bettor to successfully wager on whether the Dealer's hand or the Player's hand is going to win. The bettor receives even money for his wager if s/he selects the winning hand and loses his wager if he selects the losing hand. Because of the rules of play of Mini-Baccarat, and more particularly the pre-established draw rules, the Dealer's hand has a slightly higher chance of winning than does the Player's hand. The winning frequency for the Dealer's hand has been determined to be approximately 0.45859 (45.859%) whereas the winning frequency for the Player hand is 0.44624 (44.624%) with the remainder of the outcomes being ties. Therefore, if the bettor wagers on the Dealer's hand and the Dealer hand wins, the bettor must pay to the gaming establishment a commission (typically, 5%) of the amount the bettor wins. No commission is paid if the bettor successfully wagers on the Player's hand.

Generally speaking, Mini-Baccarat is played as follows. A multiple number of decks of standard playing cards, 52 in number, are used; typically eight decks are shuffled together and placed in a shoe from which the cards are dealt during the play of the game. Each bettor makes a wager on whether the Dealer's hand or the Player's hand will win. After all wagers are made, two cards are dealt from the shoe to the Dealer position and two cards are dealt from the shoe to the Player position on the table layout. The cards are turned face up and the value of the Dealer hand the Player hand is determined, modulo ten.

Aces count one; Kings, Queens, Jacks and Tens count zero and the other cards count their respective face value. The suits (Spades, Hearts, Diamonds and Clubs) have no meaning in Mini-Baccarat.

The highest hand value in Mini-Baccarat is nine. All hand values range from a low of zero to a high of nine. If when the cards are added together, the total of the hand exceeds nine, then the hand value is determined modulo ten. For example, a seven and eight total fifteen, but the hand value is five. Any hand having a value that is ten or a multiple of ten is ZERO. For example, an Ace and a nine total ten, but the hand value is zero.

Traditional Mini-Baccarat is played with two cards. A third card is only drawn under these rules in the following circumstances:

Rule #1: If the initial two card Player hand has a point total of 0,1, 2, 3, 4 or 5, the Player hand draws a third card. If the initial two-card Player hand has a point total of 6 or 7, the Player hand stands and does not receive a third card.

Rule #2: If the Player hand stands and does not draw a third card, then the Dealer hand follows Rule #1. In other words, if the Player hand has a point total of 6 or 7, the Dealer hand draws a third card on a point total of 0, 1, 2, 3, 4 or 5 and the Dealer hand stands on a point total of 6 or 7.

Rule #3: If the Player hand draws a third card, the Dealer hand must draw or stand in accordance with rules that are well known.

In particular there is a need for a modified game of Mini-Baccarat that is more exciting to play. In particular there is a need for a modified game of Mini-Baccarat with multiple wager options.

There is also a need for a modified game of Mini-Baccarat that does not employ commissions. Commissions generally discourage play. There is a need therefore for a modified game wherein the return to the House is built into the modified game without commissions.

SUMMARY OF THE INVENTION

A first aspect of this invention is a method of playing a modified version of Mini-Baccarat with multiple wager options.

A second aspect of this invention is a gaming surface for playing a modified game of Mini-Baccarat with multiple wager options.

BRIEF DESCRIPTION OF THE DRAWINGS

A detailed description of the preferred embodiment(s) is(are) provided herein below by way of example only and with reference to the following drawings, in which.

Figure 1:
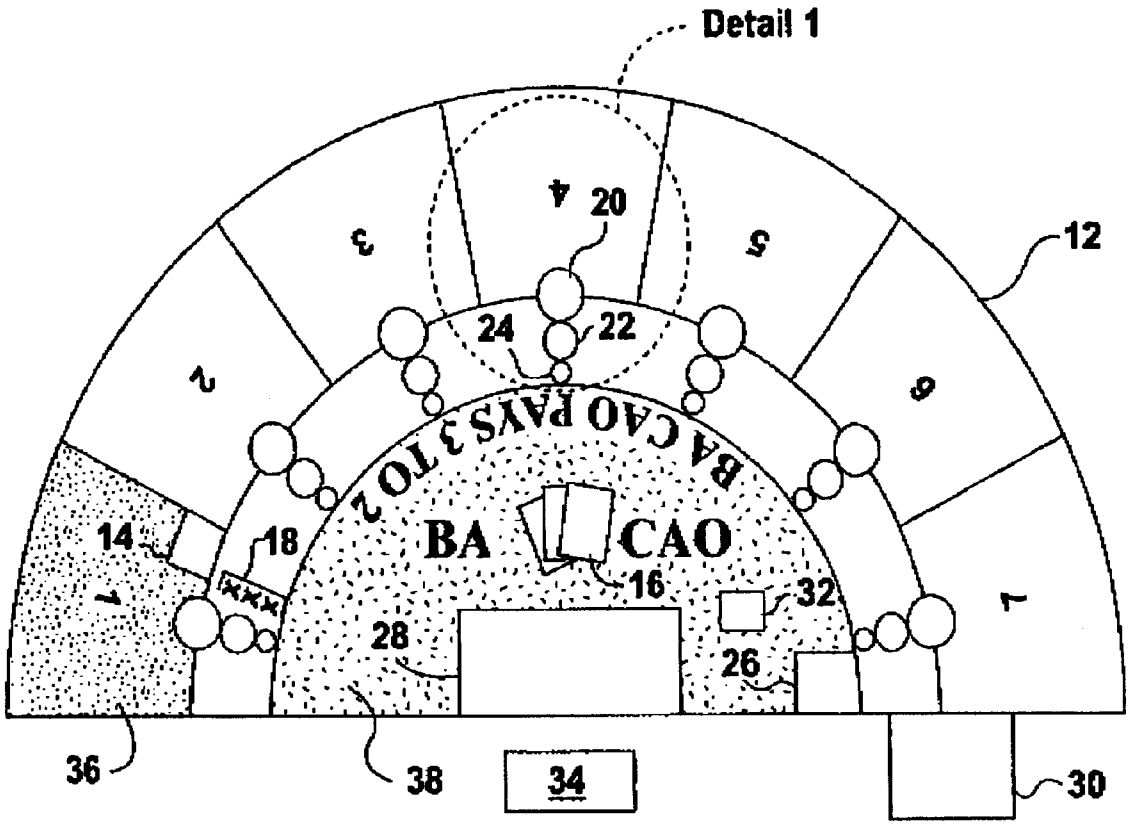
FIG. 1 is a top view of the game surface of the present invention illustrating the game surface layout disclosed herein, in accordance with a first preferred embodiment.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

The invention is best understood by illustration of the playing of the card game of the present invention.

It should be understood that the game of the present invention can be played manually or using a card shuffling device such as Shuffle Master™.

The rank of the cards used in game of the present invention is KINGS, QUEENS, JACKS, TEN, NINE, EIGHT, SEVEN, SIX, FIVE, FOUR, THREE, TWO AND ACE (ONE). The KING, QUEEN, JACK and TEN with its cards count as ZERO point, an ACE counts as one, all the other cards count as their face value. Therefore the cards played are those used in Mini-Baccarat. There are, however, a number of differences between the card game of the present invention and conventional Mini-Baccarat that are outlined below.

Firstly it should be noted that the game of the present invention is always played with three cards.

The present invention also contemplates a particular method for multiple player implementation that is described below. This particular implementation is directed at increasing the randomness of the cards received by individual players, as well as the perception of such randomness with the individual players.

Once the Dealer has shuffled the cards (or used an automated shuffler) and the cut has been completed, the Dealer shall announce "No more bets" prior to dealing, in the preferred embodiment of the present invention wherein the gaming surface of the present invention has seven places for players, eight stacks of three cards each to the area in front of the table inventory containers.

The Dealer shall deal the first three cards moving from left to right and the second three cards in the same the direction a until there are eight stacks of three cards.

After eight stacks of three cards have been dealt, the Dealer shall determine that exactly 28 cards are left. The cards shall not be exposed to anyone at the table and shall then be placed in the discard rack.

In accordance with the present invention, once the Dealer has completed dealing the eight stacks and places the 28 cards remaining cards in the discard rack, the Dealer shall then initiate a chance device 10 such as a plurality of dice in a cup so as to obtain a random number. This random number is used to determine which of the eight stacks is given to which of the players and Dealer. The stack farthest to the left of the Dealer shall be considered the eighth position; the position of the Dealer is considered to be the first position. The chance device 10 is used to obtain on a random basis a number that is used to determine which of the positions will receive the first of the eight hands dealt by the Dealer. The random number is counted counterclockwise with the Dealer being counted first, position seven being counted first, and so on counterclockwise. Once it is determine in accordance with this method which of the positions receives the first hand, the first hand is place to that position, and the remaining other hands are distributed clockwise to the remaining positions.

The Dealer then delivers the first stack to the starting position as determined in accordance with the above, thereafter delivering the remaining stacks moving counter clockwise. This is done regardless of whether there is a wager at each of the multiple positions. The Dealer shall deliver all stacks face down.

After the eight stacks have been delivered to each position, the Dealer shall collect any stacks dealt to a position where there is no wager and place them in the discard rack without with exposing the cards.

In accordance with the above, each player and the Dealer will receive three cards. The value of these cards is added together , by adding all the points of their hand together to get the total of the point.

Wagers are placed at any time before the cards are exposed.

In order to understand the multiple wager options provided by the card game of the present invention, it is important to understand how the value of a particular hand is calculated. The value of hands is calculated in accordance with traditional Mini-Baccarat as described above. To reiterate the key points, however:

A ten or face card is ZERO points.

An Ace counts as ONE point.

All other cards count in accordance with their face values.

To this point the card values are identical to those in Mini-Baccarat. However, the card game of the present invention also contemplates a BONUS hand referred to as "BA CAO" which consists of three cards, all of which are face cards in any suit.

In accordance with the above, "BA CAO" is the highest valued hand. A Nine is the second highest. The value of hands thereafter decreases from Eight to Zero.

Each Player at the table 12 shall be responsible for opening his/her own hand and no other person except the Dealer may touch the cards of that Player. Each Player shall be required to keep the three cards in full view of Dealer at all times. Once each Player has opened a hand and placed a hand faced up on an appropriate area of the layout, the Player are not to touch their cards again.

After all Players have opened their hands and placed their cards on the table, the three cards of the Dealer shall be turned over and the Dealer announced how much the points the Dealer has, then placed the hands face up on an appropriate area of the layout.

The Dealer will check the entire Players' hands and compare: Winning hand, Losing hand, a Tie hand and Bonus hands. The meaning of these hands is explained in relation to the wagers provided by the card game of the present invention.

There are three types of wagers provided by the card game of the present invention: (1) the Original Bet; (2) the Tie Bet; and (3) the Bonus Bet.

The Original Bet consists of a bet on a player that the player's hand will beat the Dealer's hand, in the sense of having a higher value as determined in accordance with the hand values defined above. It is important to note that on an Original Bet a player will suffer an Automatic Loss if his/her hand is worth Zero points, even if the Dealer's hand is also worth Zero points. This feature of the present invention is best understood as a built in commission. A winning wager is paid at 1 to 1, as is the case with Baccarat. However, a win based on achieving "BA CAO" shall pay out at 1½ to 1. Even if the Dealer has "BA CAO", if a player also has "BA CAO", the player wins. This feature also increases excitement of the game as players will all be looking for a particular value, namely "BA CAO".

The Tie Bet consists of placing a bet that the value of the player's hand and the Dealer's hand will be tied. It should be noted that no Tie Bet is possible on the Zero point. This means that if the Dealer has Zero Points, then the player will lose on a Tie Bet. This feature of this method is also part of the integrated commission of the present invention. If the player's hand and dealer's hand has the same value, then a Tie Bet will pay at 9 to 1 odds.

The Bonus Bet consists of betting that the player's hand will have on of predetermined values: "BA CAO", nine or eight. Any other value results in an Automatic Loss. BA CAO pay 20 to 1 odds; 9 points pay 3 to 1 odds; and 8 points pay 2 to 1 odds.

All losing wagers are preferably immediately collected by the Dealer and placed in the chip rack.

If a hand is a push, the Dealer shall not collect the cards or pay the wager (if the Player is betting on the tie bet), but shall immediately collect the cards of that Player. If the Dealer's hand and Player's hand have the same point or the same total, a wager made by a Player shall be a push.

All winning hands shall remain face up on the layout. Winning wagers shall be paid after all hands have been exposed. The Dealer shall pay winning wagers beginning with the Player farthest to the right of the Dealer and continuing counter clockwise around the table.

The present invention also contemplates placement of multiple wagers, including wagers by a particular player on a particular other player. The placement of such wagers may be subject to approval by the Floor. The placement of such wagers may also be subject to the consent of each player on whom other players wish to place a bet. Multiple wagers involve passing on of token or chips from a first player to a second player on whom the first player is placing a bet. The collection of winnings is generally as between the first and second player and the Dealer does not get involved. This aspect of multiple wagers by players on each other also increases the excitement of the card game disclosed herein. The wagers and payment on wagers in regard to player-on-player wagers is in accordance with the description above.

As is well known, it is possible to calculate the House's return on each of the three wagers described above.

On an Original Bet, the House's return is approximately 8.3958%. This is calculated by determining the probability of all of the winning options (to players) and the pay-out on same which is as stated above 1½% to 1. Accordingly, 2164/21844−(220×1.½)×100=8.3958%.

On a Tie Bet, based on a similar calculation, the House will receive a 10.9064% return.

Lastly, the Bonus Bet will give the House a 9.5037% return.

The returns are in line with returns generally sought by casino establishments. Accordingly, it is clear that the card game disclosed herein adequately compensates for the omission of the house commission by means of the Zero point rule discussed above.

As stated earlier, the present invention is also understood as a gaming surface, as illustrated in FIG. 1, wherein three betting surfaces are provided: an Original bet surface 20, Tie bet surface 22 and Bonus bet surface 24.

Other variations and modifications of the invention are possible. For example, a gaming apparatus is provided for playing the card game in accordance with the method of the present invention, including a display, player interface for receiving player input, and processor configured to effect game play, the processor enabling the method according to the invention. This apparatus is provided in a manner that is well known. As would be apparent to those skilled in the relevant art, the invention can be embodied in a wide variety and forms of media, but not limited to single player slot video machines, multi-player slot video machines, electronic games and devices, lottery terminals, scratch-card formats, software, as well as in-flight, home and Internet entertainment. In addition, the invention can be readily implemented as a computer program product (e.g. floppy disk, compact disk etc.) comprising a computer readable medium having control logic recorded therein to implement the features of the invention as described in relation to the other preferred embodiments. Specifically, the chance device would be replaced in this medium by a random selecting means, in a manner that is well-known, that randomly selects the numerical value referred to in this disclosure. Control logic can be loaded into the memory of a computer and executed by a central processing unit (CPU) to perform the operations described herein. It should be understood also that the present gaming surface can be provided as a game board to be played in accordance with the invention described herein. All such modifications or variations are believed to be within the sphere and scope of the invention as defined by the claims appended hereto.

We claim:

1. A method of playing a betting game of the mini-Baccarat type, comprising the steps of:

(a) Determining standard values for a standard deck of 52 playing cards, with said values being: Ace=1, Ten/King/Queen/Jack=0, and the remaining cards having their face value, whereby three cards cumulative value is determined by adding their value unless the total of such three cards exceeds nine but is less than twenty, in which case the value of the three cards is determined by subtracting ten from the cumulative value of the three cards, and if the total of the hand is twenty or greater the value of the three cards is determined by subtracting twenty from the cumulative value thereof;

(b) Determining a bonus hand for a standard deck of 52 playing cards consisting of a bonus hand of three face cards in any suit;

(c) Dealing three cards face down to each of one or more players and a dealer, each of the one or more players defining a playing position;

(d) Receiving bets on the card value of the three cards of one or more of the various playing positions; and (e) Establishing the value of the three cards for each of the dealers and the various playing positions and applying the bets.

2. The method of playing a betting game claimed in claim 1, whereby each player may place a bet that one or more of the playing positions shall have a card value greater than me card value of the dealer's hand, whereby if the card value of the playing position and the dealer's position is both 0, the dealer wins, such aspect of the betting game constituting an inherent commission.

3. The method of playing a betting game claimed in claim 2, whereby any player betting on a playing position that achieves the bonus hand wins, even when the dealer also achieves the bonus hand.

4. The method of playing a betting game claimed in claim 3, whereby a win based on the bonus hand pays out at 1½ to 1.

5. A method of playing a betting game as claimed in claim 1, whereby the game includes the step whereby a bet is placed that the value of the three cards of one or more of the plurality of players will have a specific value based on the established parameters, and whereby the specific value includes a bonus bet value whereby the card value is one of the bonus hand, nine or eight, and any other card value results in an automatic loss.

6. A method of playing a betting game as claimed in claim 1, whereby the three cards having the second highest value after the bonus hand have the cumulative value of nine.

7. A method of playing a betting game as claimed in claim 1, whereby a chance device is used to randomly select which of the plurality of players or the dealer receives which of the three cards comprising the steps of:

dealing the cards on a random basis into a plurality of stacks each stack comprising three cards, the plurality of stacks corresponding to the plurality of players plus the dealer;

engaging a chance device to randomly select which of the plurality of stacks is given to which of the plurality of players and the dealer; and delivering each of the plurality of stacks to each such selected player and the dealer.

8. A method of playing a betting game as claimed in claim 7, whereby the stack farthest to the left of the dealer is considered the eighth position, and the position of the dealer is considered to be the first position, whereby the chance device is used to randomly select a number between one and eight, whereby the first stack is placed in the position having a rank corresponding to the number so selected, the remaining stacks being distributed in sequence counterclockwise.

9. A method of playing a betting game as claimed in claim 1, whereby no commission is charged and rather an inherent commission is utilized.

* * * * *